US012604990B2

(12) United States Patent
Pao

(10) Patent No.: US 12,604,990 B2
(45) Date of Patent: Apr. 21, 2026

(54) FOLDABLE DEVICE

(71) Applicant: STEP2GOLD CO., LTD., Taichung City (TW)

(72) Inventor: Chih-Ting Pao, Taichung City (TW)

(73) Assignee: STEP2GOLD CO., LTD., Taichung City (TW)

( * ) Notice: Subject to any disclaimer, the term of this patent is extended or adjusted under 35 U.S.C. 154(b) by 172 days.

(21) Appl. No.: 18/441,623

(22) Filed: Feb. 14, 2024

(65) Prior Publication Data

US 2025/0143472 A1 May 8, 2025

(30) Foreign Application Priority Data

Nov. 2, 2023 (TW) ..... 112142251

(51) Int. Cl.
*A47C 9/10* (2006.01)

(52) U.S. Cl.
CPC ..... *A47C 9/105* (2013.01)

(58) Field of Classification Search
CPC ..... A47C 9/105; A47C 9/10; A47C 4/286
See application file for complete search history.

(56) References Cited

U.S. PATENT DOCUMENTS

| | | | | | |
|---|---|---|---|---|---|
| 413,962 | A * | 10/1889 | Putnam | A47C 9/105 | 248/155.5 |
| 647,171 | A * | 4/1900 | Wiles | A47B 3/02 | 108/118 |
| 6,270,156 | B1 * | 8/2001 | Metzger | A47C 4/286 | 297/16.2 |
| 11,432,651 | B2 * | 9/2022 | Pao | A45B 5/00 | |
| 11,700,946 | B2 * | 7/2023 | Pao | A47C 9/105 | 297/16.2 |
| 2022/0061535 | A1 * | 3/2022 | Pao | A47C 9/105 | |
| 2022/0240682 | A1 * | 8/2022 | Pao | A45B 5/00 | |
| 2024/0041217 | A1 * | 2/2024 | Pao | A45B 5/00 | |
| 2025/0143466 | A1 * | 5/2025 | Pao | A47C 4/286 | |

* cited by examiner

*Primary Examiner* — Philip J Bonzell
(74) *Attorney, Agent, or Firm* — BURRIS LAW, PLLC

(57) ABSTRACT

A foldable device includes a pivot base, three supporting rods, at least one folding rod unit, a linkage rod, and a pivot member that is located above the pivot base. The linkage rod has a pivot section that is pivotably connected to the pivot member, and a moving section that is opposite to the pivot section. The at least one folding rod unit is pivotably connected to one of the supporting rods. The moving section of the linkage rod is slidably mounted to the at least one folding rod unit. The at least one folding rod unit includes a folding rod that has a connecting section and a swing section, and that is movable relative to the one of the supporting rods between a folded position, in which the moving section of the linkage rod is adjacent to the swing section of the folding rod, and an expanded position.

8 Claims, 15 Drawing Sheets

FOLDABLE DEVICE

CROSS-REFERENCE TO RELATED APPLICATION

This application claims priority to Taiwanese Invention patent application No. 112142251, filed on Nov. 2, 2023, the entire disclosure of which is incorporated by reference herein.

FIELD

The present disclosure relates to a foldable device, and more particularly to a foldable device that has a folding rod.

BACKGROUND

A conventional folding chair includes three leg rods that are operable to rotate simultaneously, and a cloth member. Each of the leg rods has a top section. The cloth member interconnects the top sections of the leg rods. The leg rods are rotatable between a folded position and a supporting position. When the leg rods are in the folded position, the top sections of the leg rods are close to each other such that the cloth member is folded, thereby facilitating storage of the conventional folding chair. When the leg rods are in the supporting position, the top sections of the leg rods are distal from each other such that the cloth member is spread out, thereby providing a seat for a user.

However, the leg rods are made to be short so that the conventional folding chair may be convenient to carry. Consequently, when the leg rods are in the supporting position, the conventional folding chair may not provide a sufficient space for the user to comfortably sit thereon. In addition, other conventional foldable devices (e.g., a folding table) also have the problem of not providing enough space, thereby not being user-friendly.

SUMMARY

Therefore, an object of the disclosure is to provide a foldable device that can alleviate the drawback of the prior art.

According to the disclosure, the foldable device includes a pivot base, three supporting rods, a linkage unit, and at least one folding rod unit. The supporting rods extend through the pivot base. Each of the supporting rods has a top section that is located above the pivot base. The linkage unit includes a pivot member that is located above the pivot base, and a linkage rod that is pivotably connected to the pivot member. The linkage rod has a pivot section that is pivotably connected to the pivot member, and a moving section that is opposite to the pivot section. The at least one folding rod unit is pivotably connected to one of the supporting rods. The moving section of the linkage rod is slidably mounted to the at least one folding rod unit. The at least one folding rod unit includes a folding rod that has a connecting section which is pivotably connected to the top section of the one of the supporting rods, and a swing section which is opposite to the connecting section. The folding rod of the at least one folding rod unit is movable relative to the one of the supporting rods between a folded position, in which the swing section of the folding rod is adjacent to the pivot base, in which the pivot section of the linkage rod is adjacent to the folding rod, and in which the moving section of the linkage rod is adjacent to the swing section of the folding rod, and an expanded position, in which the swing section of the folding rod is distal from the pivot base and is located at one side of the top section of the one of the supporting rods opposite to the pivot base, and in which the moving section of the linkage rod is distal from the swing section of the folding rod.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
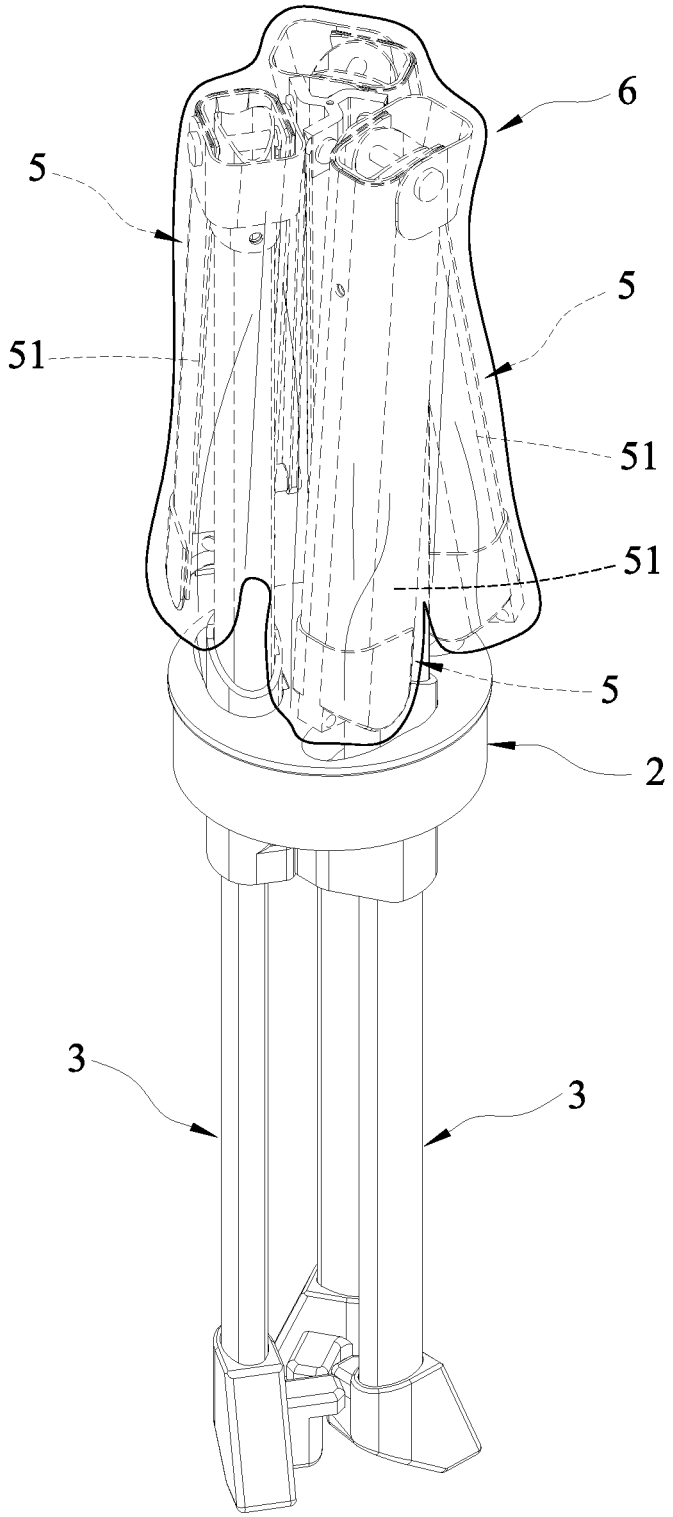
FIG. 1 is a perspective view of a first embodiment of a foldable device according to the disclosure, illustrating each of supporting rods of the first embodiment in a storage position and a folding rod of each of folding rod units of the first embodiment in a folded position.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
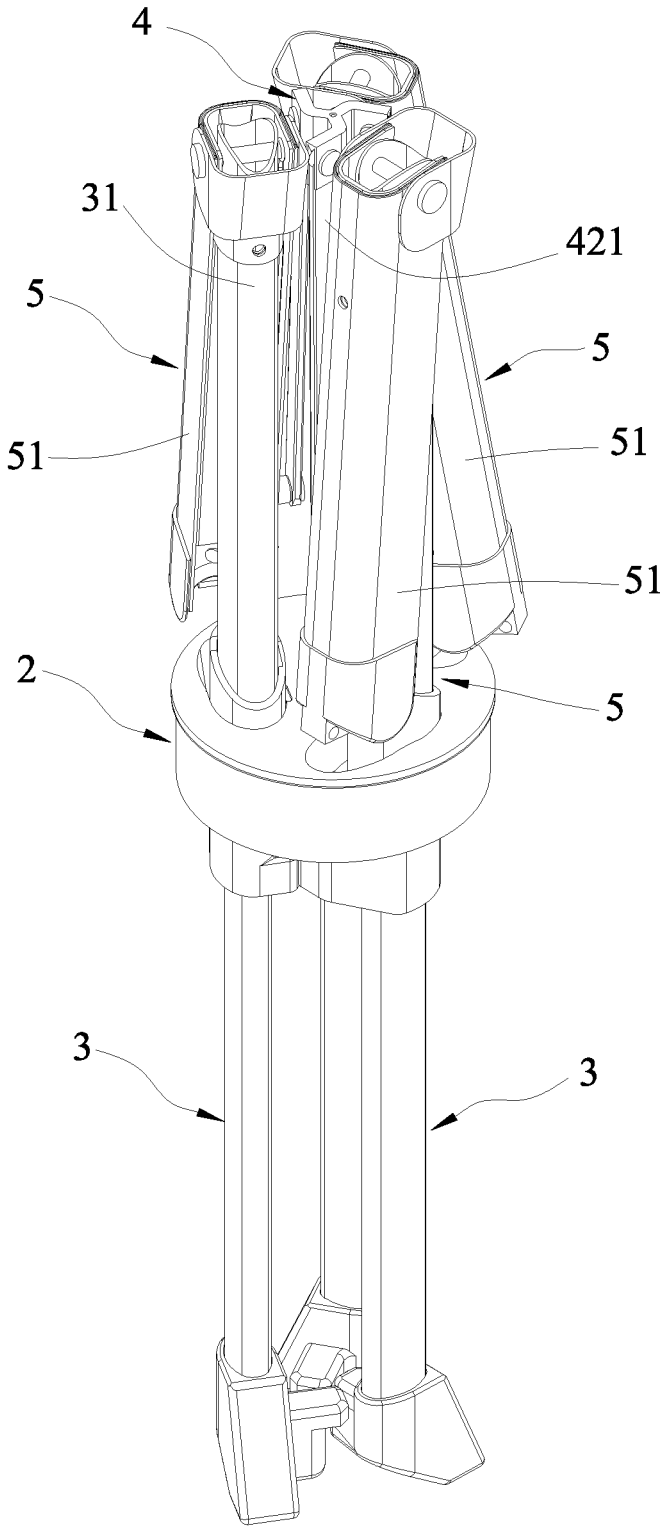
FIG. 2 is a perspective view of part of the first embodiment, illustrating each of the supporting rods in the storage position and the folding rod of each of the folding rod units in the folded position.
Figure 3:
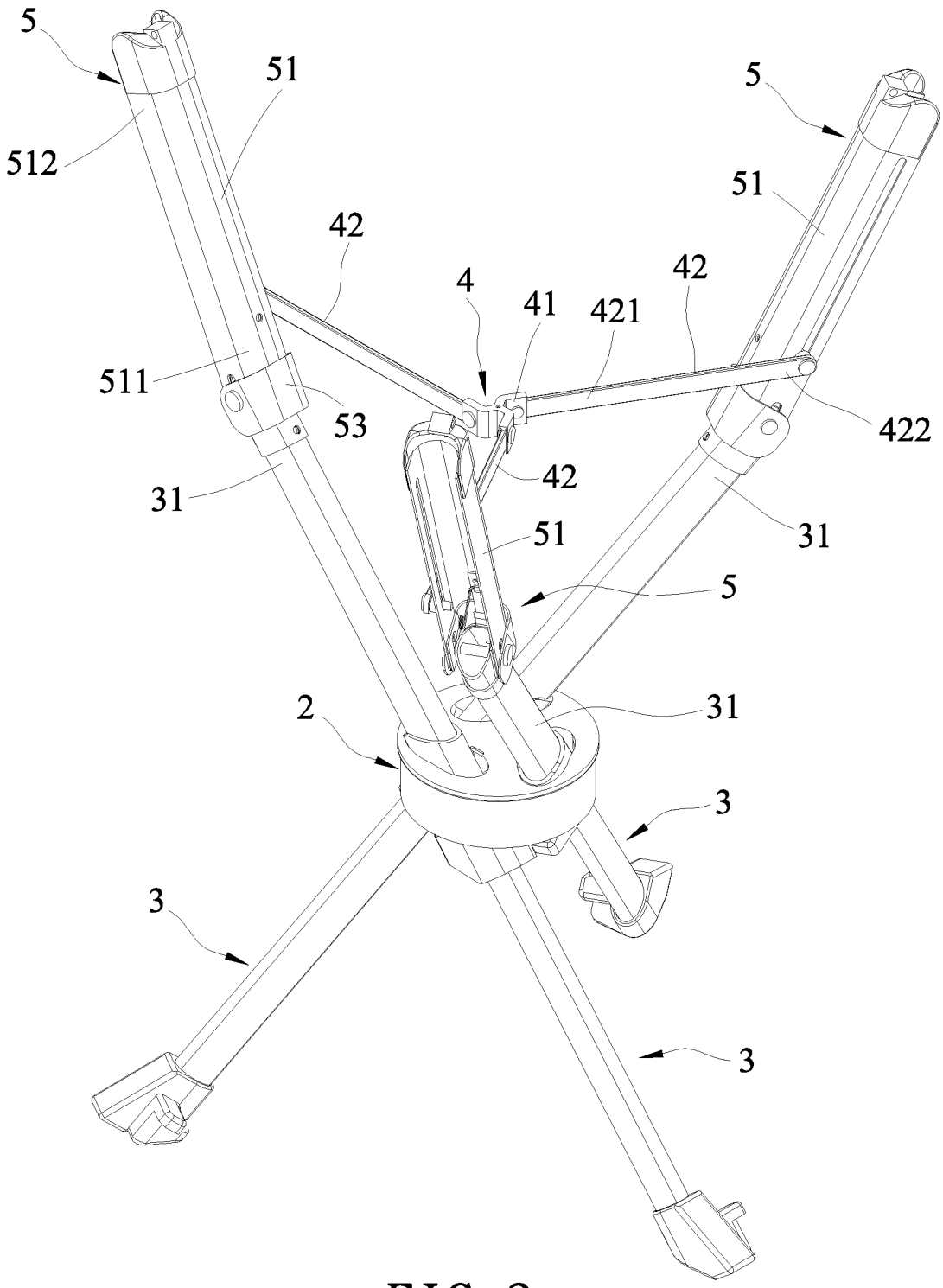
FIG. 3 is a perspective view of part of the first embodiment, illustrating each of the supporting rods in a supporting position and the folding rod of each of the folding rod units in an expanded position.

Referring to FIGS. 1 to 3, a first embodiment of a foldable device according to the disclosure includes a pivot seat 2, three supporting rods 3, a linkage unit 4, three folding rod units 5, and a cloth member 6.

The supporting rods 3 extend through the pivot base 2. Each of the supporting rods 3 has a top section 31 that is located above the pivot base 2.

Each of the supporting rods 3 is movable relative to the pivot base 2 between a storage position and a supporting position. When each of the supporting rods 3 is in the storage position (see FIGS. 1 and 2), the top sections 31 of the supporting rods 3 are proximate to each other. When each of the supporting rods 3 are in the supporting position (see FIG. 3), the top sections 31 of the supporting rods 3 are distal from each other, and the supporting rods 3 respectively incline in different directions.

Figure 4:
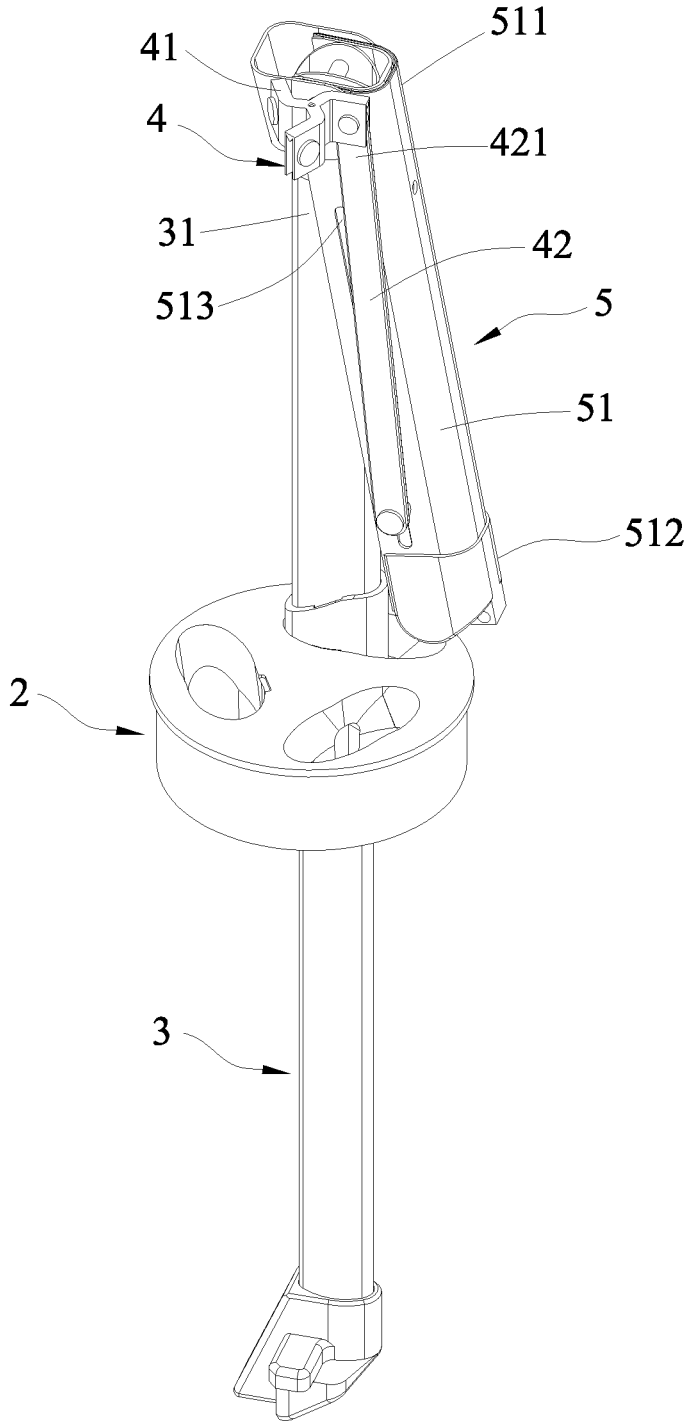
FIG. 4 is a perspective view of part of FIG. 2.
Figure 5:
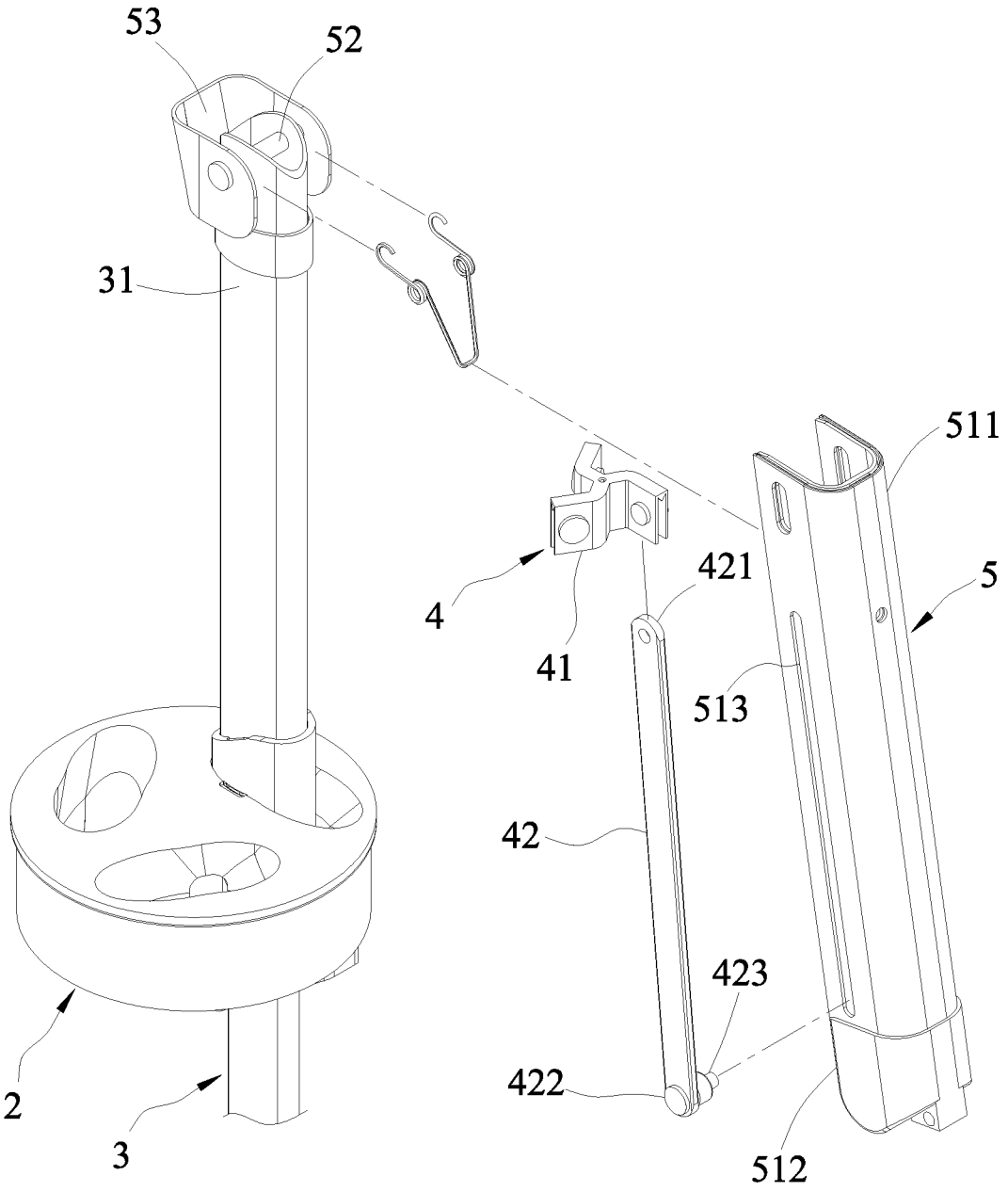
FIG. 5 is a fragmentary, partly exploded perspective view of FIG. 4.

Referring to FIGS. 4 and 5, in cooperation with FIG. 3, the linkage unit 4 includes a pivot member 41 that is located above the pivot base 2, and three linkage rods 42 each of which is pivotably connected to the pivot member 41.

Figure 6:
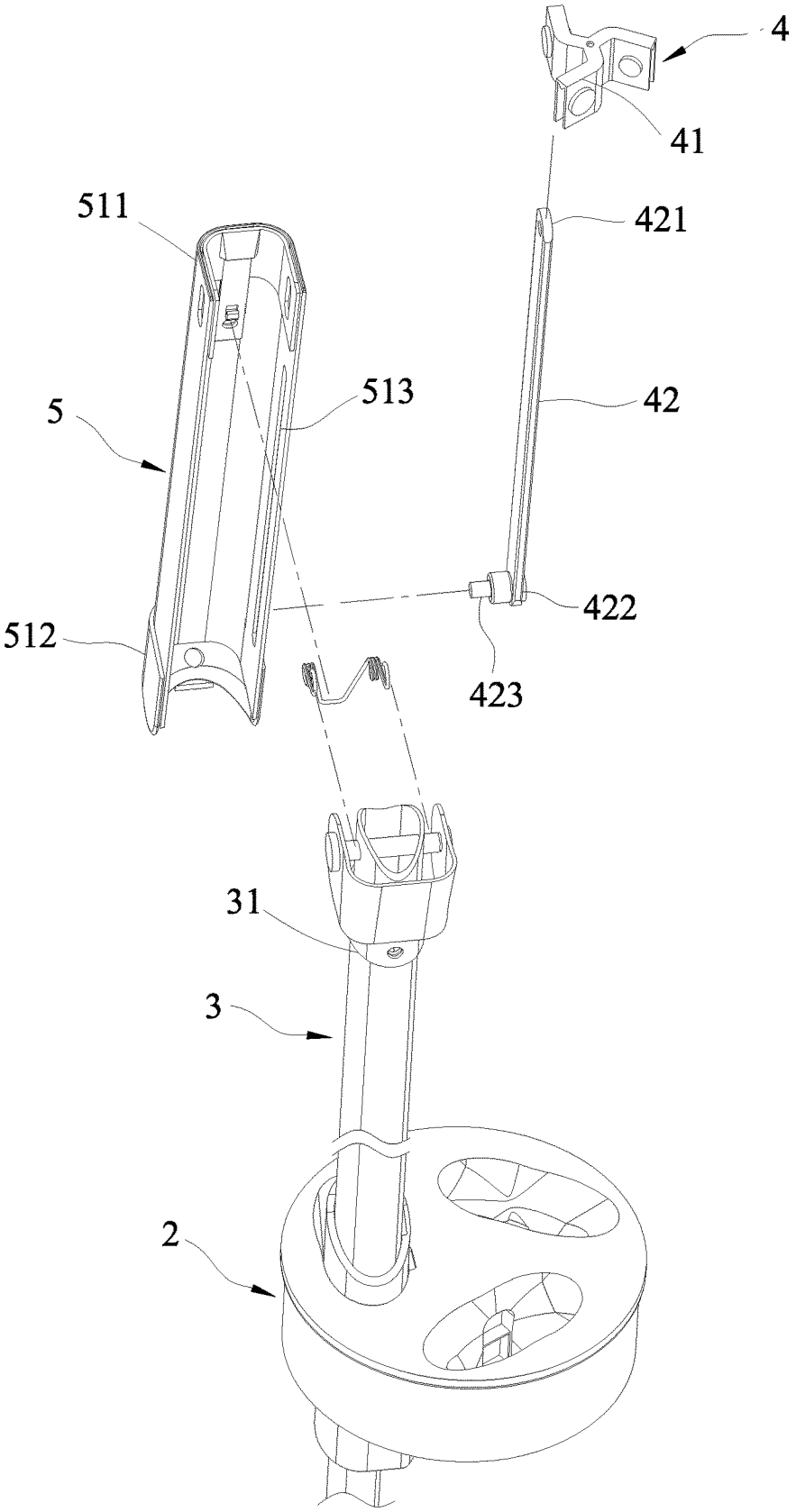
FIG. 6 is a fragmentary, partly exploded perspective view of FIG. 4 taken from another viewing angle.
Figure 7:
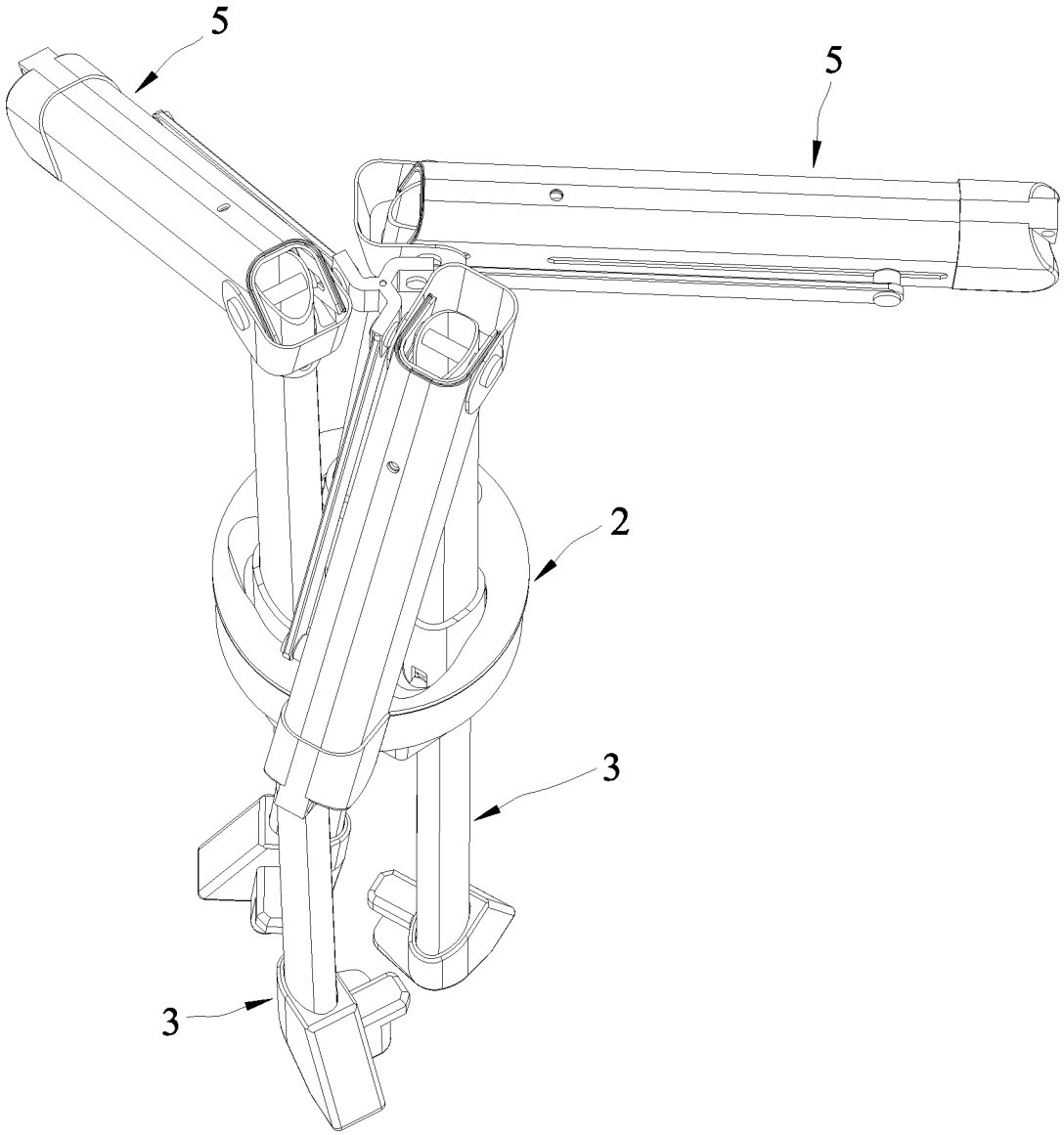
FIG. 7 is a schematic view illustrating each of the supporting rods in a position between the storage position and the supporting position and the folding rod of each of the folding rod units in a position between the folded position and the expanded position.
Figure 8:
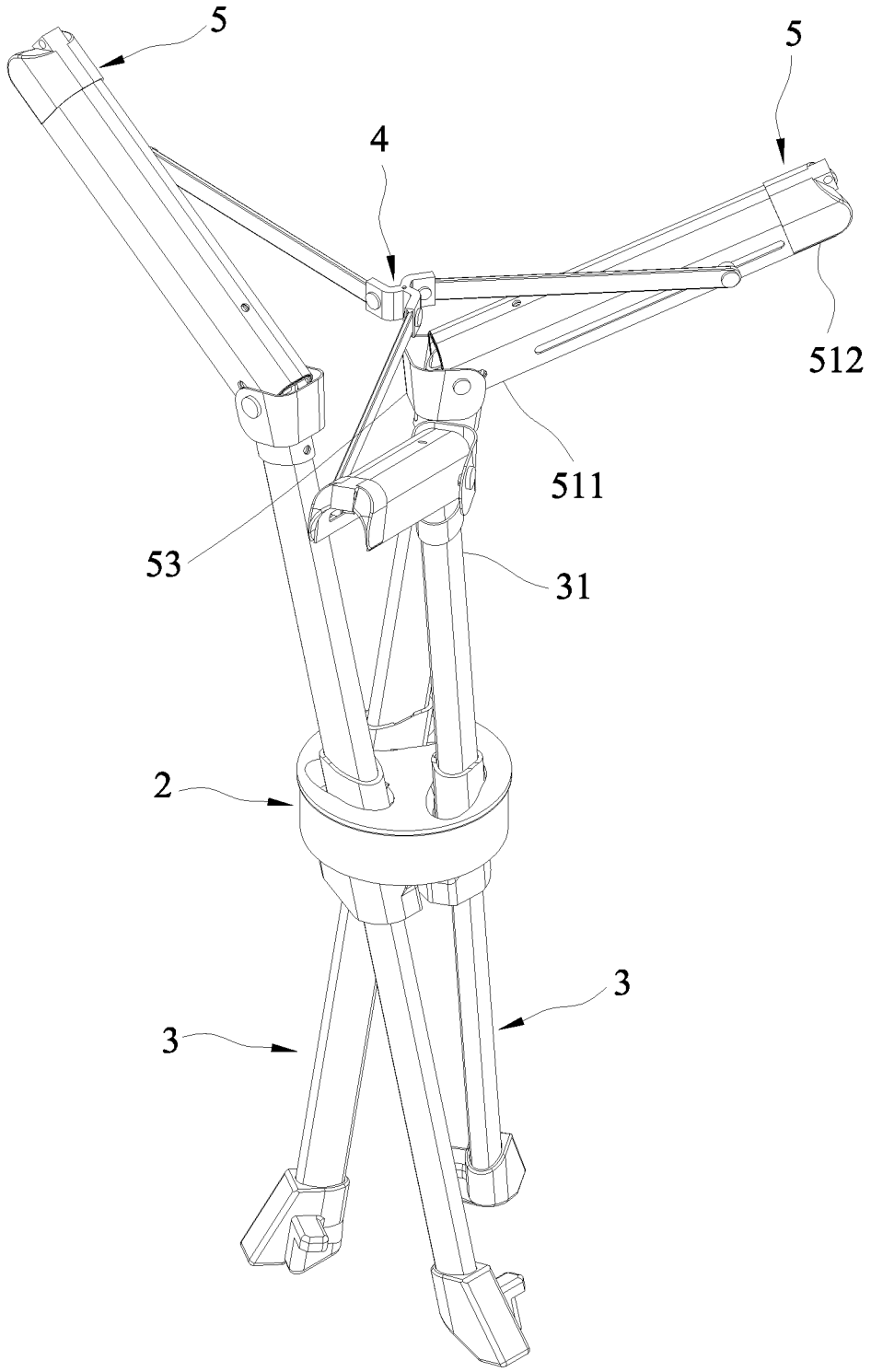
FIG. 8 is a schematic view illustrating each of the supporting rods in another position between the storage position and the supporting position and the folding rod of each of the folding rod units in another position between the folded position and the expanded position.

Referring to FIG. 6, in cooperation with FIGS. 3 and 5, each of the linkage rods 42 has a pivot section 421 that is pivotably connected to the pivot member 41, and a moving section 422 that is opposite to the pivot section 421. The moving section 422 of each of the linkage rods 42 includes a groove engaging member 423. In this embodiment, for each of the linkage rods 42, the pivot section 421 and the moving section 422 cooperatively define an imaginary line (not shown), and the groove engaging member 423 of the moving section 422 is elongated in a direction orthogonal to an extending direction of the imaginary line.

The folding rod units 5 are respectively and pivotably connected to the supporting rods 3. The groove engaging members 423 of the moving sections 422 of the linkage rods 42 are respectively and slidably mounted to the folding rod units 5. Each of the folding rod units 5 includes a folding rod 51, a pivot shaft 52 that is mounted to the top section 31 of the respective one of the supporting rods 3, and a blocking wall 53 that is mounted to the pivot shaft 52 and that at least partially covers the top section 31 of the respective one of the supporting rods 3. For each of the folding rod units 5, the folding rod 51 has a connecting section 511 that is pivotably connected to the top section 31 of the respective one of the supporting rods 3, a swing section 512 that is opposite to the connecting section 511, and a groove 513 that is located at the swing section 512. The groove engaging member 423 of the moving section 422 of each of the linkage rods 42 extends through the groove 513 of the folding rod 51 of the respective one of the folding rod units 5, and is movable along the groove 513 of the respective one of the folding rod units 5. In this embodiment, a cross section of the folding rod 51 of each of the folding rod units 5 is configured to be U-shaped.

The folding rod 51 of each of the folding rod units 5 is movable relative to the respective one of the supporting rods 3 between a folded position (see FIGS. 1 and 2) and an expanded position (see FIG. 3).

Referring to FIGS. 2 to 5 again, when the folding rod 51 of each of the folding rod units 5 is in the folded position, each of the supporting rods 3 is in the storage position, the swing section 512 of the folding rod 51 of the folding rod unit 5 is adjacent to the pivot base 2, the pivot section 421 of each of the linkage rods 42 is adjacent to the folding rod 51 of the respective one of the folding rod units 5, and the moving section 422 of each of the linkage rods 42 is adjacent to the swing section 512 of the folding rod 51 of the respective one of the folding rod units 5. It is noted that, the cross section of the folding rod 51 of each of the folding rod units 5 is U-shaped so that when the folding rod 51 of each of the folding rod units 5 is in the folded position, at least a portion of the top section 31 of each of the supporting rods 3 may be accommodated in the folding rod 51 of the respective one of the folding rod units 5.

When a user urges each of the folding rods 51 in the folded position to pivot relative to the respective one of the supporting rods 3, the swing section 512 of each of the folding rods 51 is swung upwardly such that each of the folding rods 51 is moved toward the expanded position. The user may realize that each of the folding rods 51 has reached the expanded position when the connecting section 511 of the folding rod 51 of each of the folding rod units 5 abuts against the blocking wall 53 of the folding rod unit 5. Specifically, the blocking wall 53 of each of the folding rod units 5 abuts against the connecting section 511 of the folding rod 51 of the folding rod unit 5 when the folding rod 51 of the folding rod unit 5 is in the expanded position, and restrains movement of the folding rod 51 of the folding rod unit 5 so that when the folding rod 51 of each of the folding rod units 5 is in the expanded position, the folding rod 51 of each of the folding rod units 5 may only be allowed to move toward the folded position. A process of the folding rod 51 of each of the folding rod units 5 being urged to move from the folded position to the expanded position is shown in FIGS. 2, 7, 8, and 3, sequentially.

Figure 9:
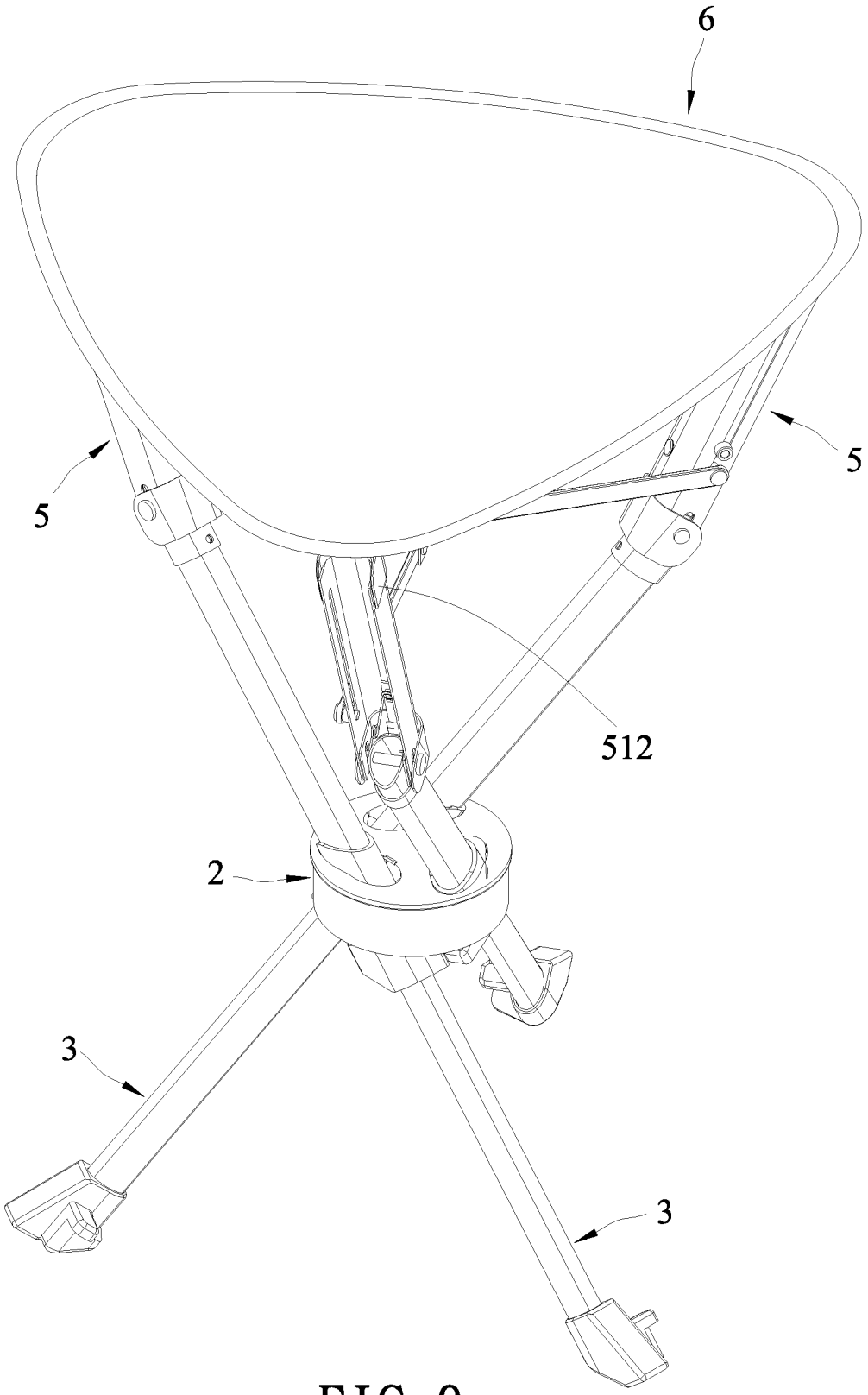
FIG. 9 is a perspective view of the first embodiment, illustrating each of the supporting rods in the supporting position and the folding rod of each of the folding rod units in the expanded position.

Referring to FIGS. 3 and 5 again, when the folding rod 51 of each of the folding rod units 5 is in the expanded position, each of the supporting rods 3 is in the supporting position, the swing section 512 of the folding rod 51 of each of the folding rod units 5 is distal from the pivot base 2 and is located at one side of the top section 31 of the respective one of the supporting rods 3 opposite to the pivot base 2, the blocking wall 53 of each of the folding rod units 5 abuts against the folding rod 51 of the folding rod unit 5 and restrains the movement of the folding rod 51 of the folding rod unit 5, the pivot section 421 of each of the linkage rods 42 is distal from the folding rod 51 of the respective one of the folding rod units 5, and the moving section 422 of each of the linkage rods 42 is distal from the swing section 512 of the folding rod 51 of the respective one of the folding rod units 5. At this time, the imaginary line defined by the pivot section 421 and the moving section 422 of each of the linkage rods 42 is horizontal, and the direction in which the groove engaging member 423 of the moving section 422 of each of the linkage rods 42 is elongated is horizontal (i.e., each of the linkage rods 42 is substantially horizontal). Referring further to FIG. 9, in cooperation with FIG. 1, the cloth member 6 is connected to the swing section 512 of the folding rod 51 of each of the folding rod units 5.

Referring to FIGS. 2, 3 and 9 again, when the user uses the foldable device, each of the supporting rods 3 is urged to move relative to the pivot base 2 from the storage position to the supporting position, and the folding rod 51 of each of the folding rod units 5 is urged to move relative to the respective one of the supporting rods 3 from the folded position to the expanded position. Consequently, the swing sections 512 of the folding rods 51 of the folding rod units 5 cooperatively spread the cloth member 6 out so that the cloth member 6 may provide a seat for the user. In this embodiment, the foldable device is configured to be a folding chair. By virtue of the portion of the top section 31 of each of the supporting rods 3 being accommodated in the folding rod 51 of the respective one of the folding rod units when the folding rod 51 of each of the folding rod units 5 is in the folded position, the foldable device is space-saving when each of the supporting rods 3 is in the storage position and the folding rod 51 of each of the folding rod units 5 is in the folded position. In addition, by virtue of the folding rod units 5 being respectively and pivotably connected to the supporting rods 3, each of the folding rods 51 may serve as an extension of the respective one of the supporting rods 3 so that when each of the supporting rods 3 is in the supporting position and the folding rod 51 of each of the folding rod units 5 is in the expanded position, the foldable device may have relatively long chair legs, and the cloth member 6 that is spread out may provide a seating area that is larger and higher than a seating area provided by a conventional folding chair. Therefore, the foldable device is relatively user-friendly.

It is noted that, in certain embodiments, the foldable device may be configured to be, but not limited to be, a folding table.

Figure 10:
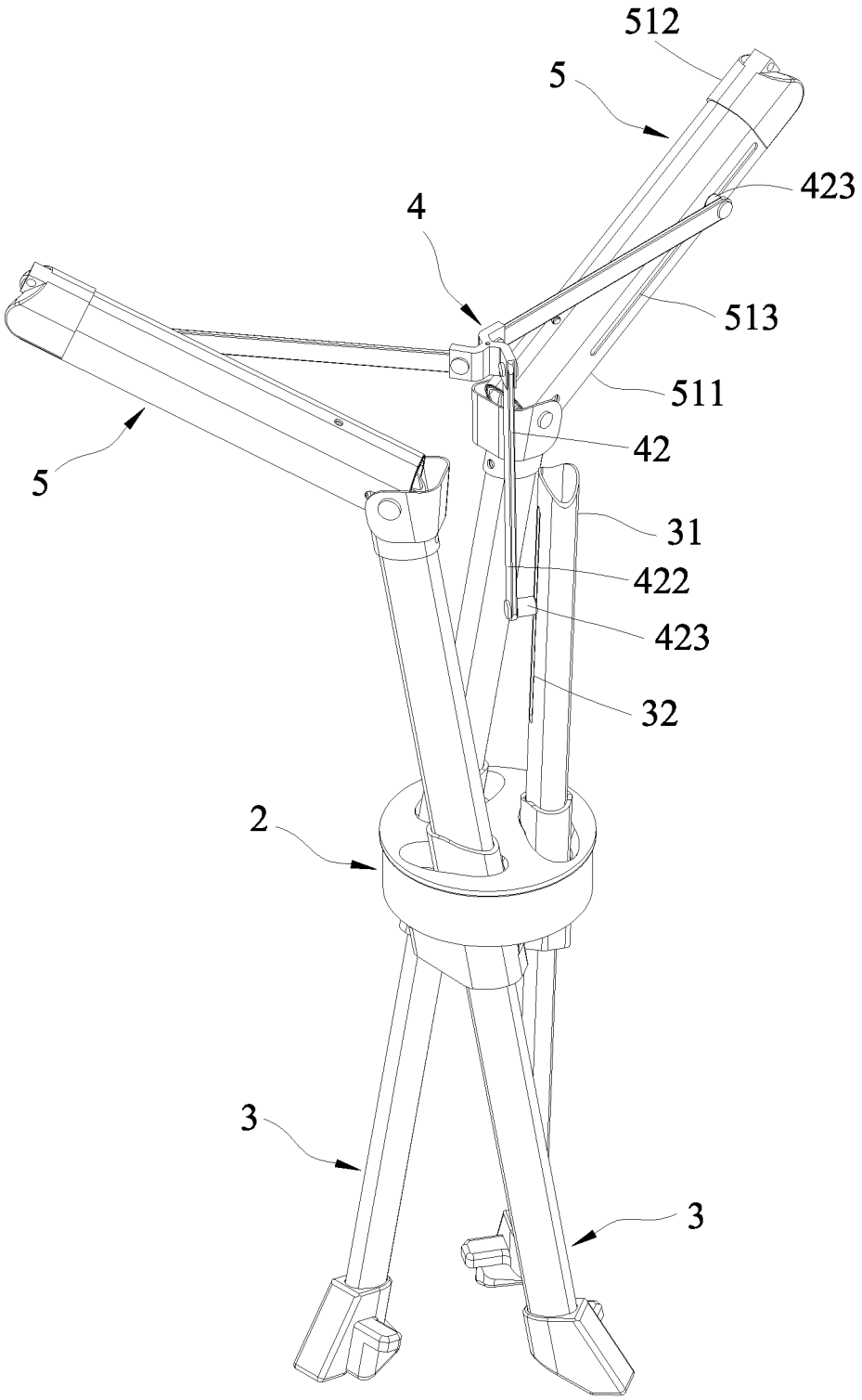
FIG. 10 is a perspective view of part of a second embodiment of the foldable device according to the disclosure.
Figure 11:
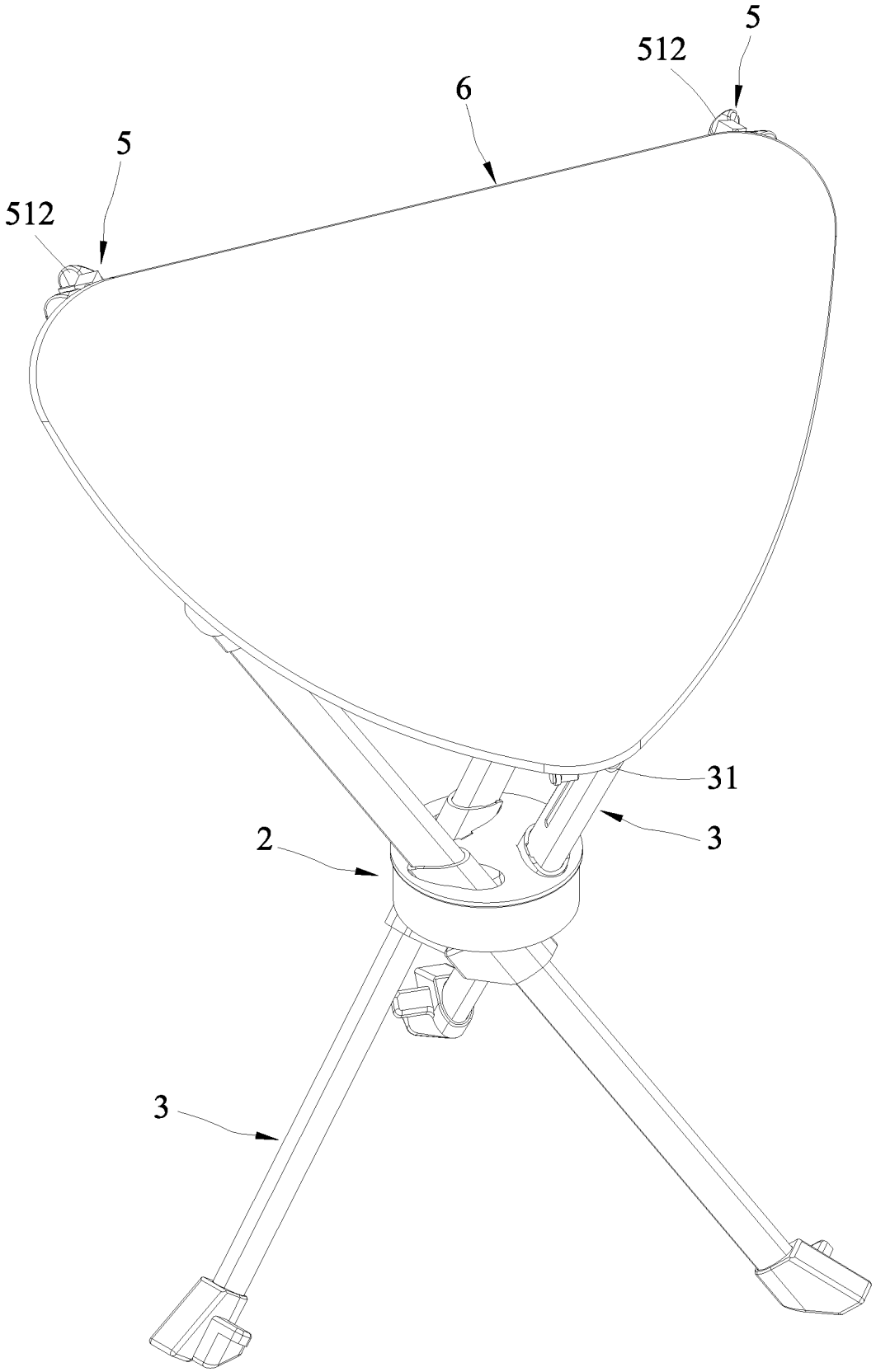
FIG. 11 is a perspective view of the second embodiment.

Referring to FIGS. 10 and 11, a second embodiment of the foldable device according to the disclosure is similar to the first embodiment, except for differences (a) to (d) below.

(a) The second embodiment includes two folding rod units 5 that are respectively and pivotably connected to two of the supporting rods 3. The groove engaging members 423 of the moving sections 422 of two of the linkage rods 42 are respectively and slidably mounted to the folding rod units 5.

(b) A remaining one of the supporting rods 3 that is not connected to the folding rod units 5 further has a groove 32 that is located at the top section 31 thereof. The groove engaging member 423 of the moving section 422 of a remaining one of the linkage rods 42 that is not mounted to the folding rod units 5 extends through the groove 32 of the remaining one of the supporting rods 3 that is not connected to the folding rod units 5, and is movable along the groove 32 of the remaining one of the supporting rods 3 that is not connected to the folding rod units 5.

(c) The cloth member 6 is connected to the swing sections 512 of the folding rods 51 of the folding rod units 5, and is connected to the top section 31 of the remaining one of the supporting rods 3 that is not connected to the folding rod units 5.

(d) When the folding rod 51 of each of the folding rod units 5 is urged to move relative to the respective one of the two of the supporting rods 3 that are connected to the folding rod units 5 from the folded position to the expanded position, the swing sections 512 of the folding rods 51 of the folding rod units 5 and the top section 31 of the remaining one of the supporting rods 3 that is connected to the folding rod units 5 cooperatively spread the cloth member 6 out so that the cloth member 6 may provide a sloping seat for the user.

Therefore, the second embodiment may achieve the same purpose and effects as the first embodiment.

Figure 12:
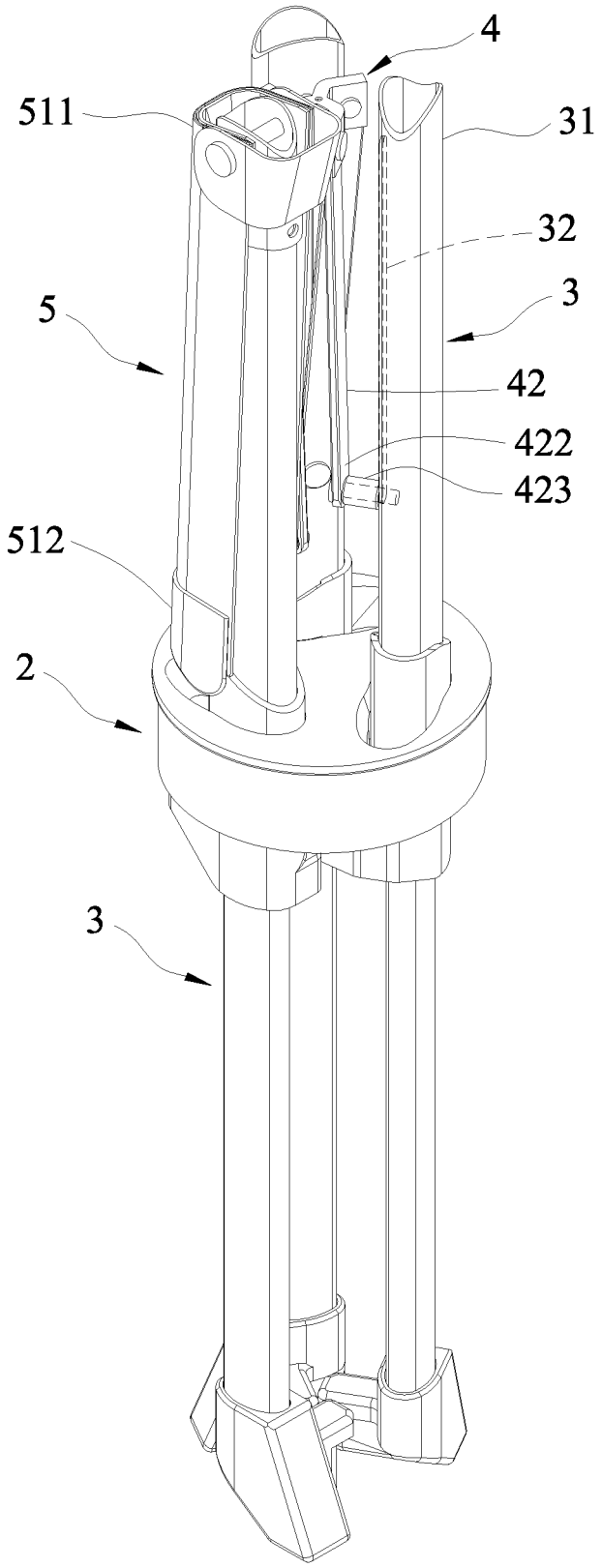
FIG. 12 is a perspective view of part of a third embodiment of the foldable device according to the disclosure.
Figure 13:
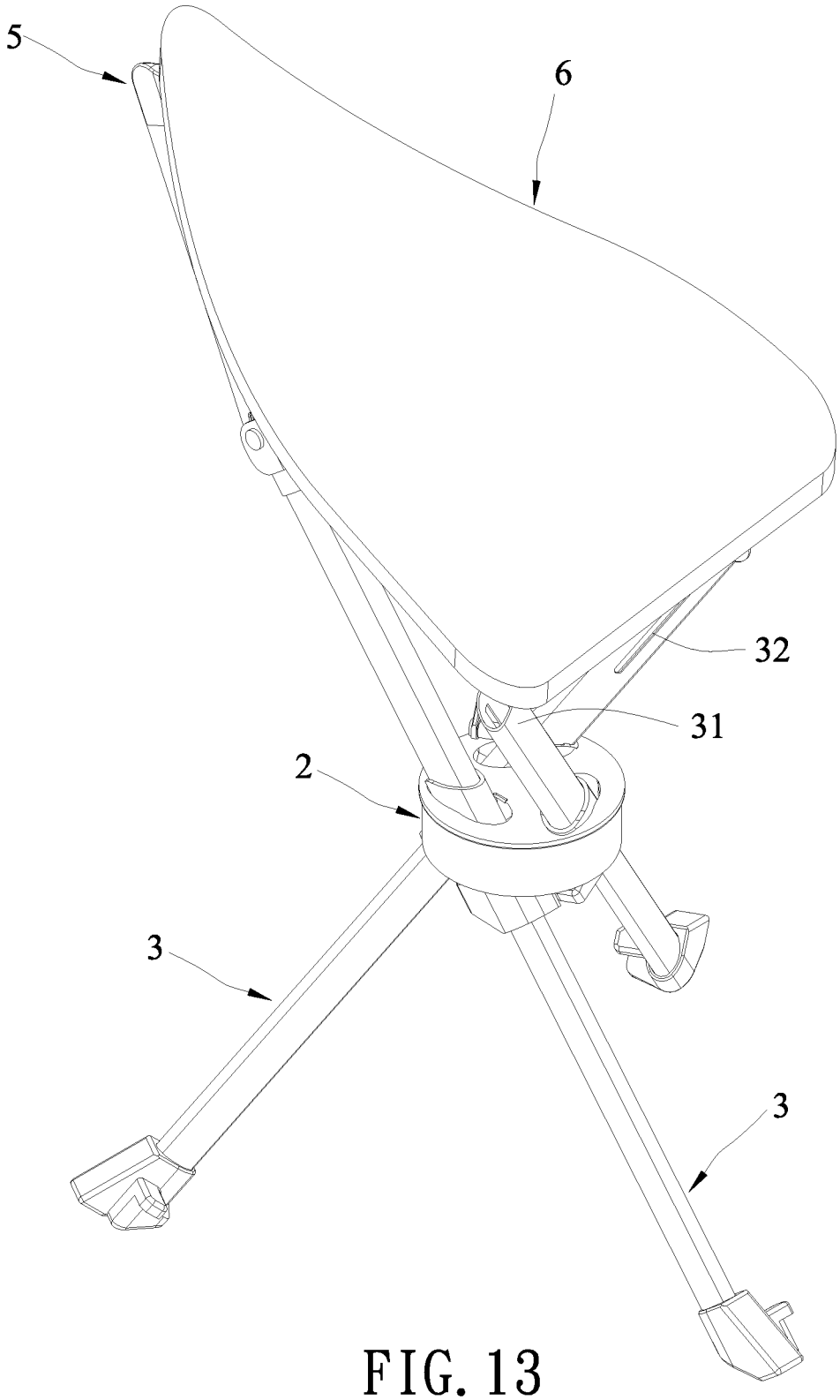
FIG. 13 is a perspective view of the third embodiment.

Referring to FIGS. 12 and 13, a third embodiment of the foldable device according to the disclosure is similar to the first embodiment, except for differences (e) to (h) below.

(e) The third embodiment includes one folding rod unit 5 that is pivotably connected to one of the supporting rods 3. The groove engaging members 423 of the moving sections 422 of one of the linkage rods 42 is slidably mounted to the folding rod unit 5.

(f) Each of remaining two of the supporting rods 3 that are not connected to the folding rod unit 5 further has a groove 32 that is located at the top section 31 thereof. The groove engaging member 423 of the moving section 422 of each of remaining two of the linkage rods 42 that are not mounted to the folding rod unit 5 extends through the groove 32 of a respective one of the remaining two of the supporting rods 3 that are not connected to the folding rod unit 5, and is movable along the groove 32 of the respective one of the remaining two of the supporting rods 3 that are not connected to the folding rod unit 5.

(g) The cloth member 6 is connected to the swing section 512 of the folding rod 51 of the folding rod unit 5, and is connected to the top sections 31 of the remaining two of the supporting rods 3 that are not connected to the folding rod unit 5.

(h) When the folding rod 51 of the folding rod unit 5 is urged to move relative to the one of the supporting rods 3 that is connected to the folding rod unit from the folded position to the expanded position, the swing section 512 of the folding rod 51 of the folding rod unit 5 and the top sections 31 of the remaining two of the supporting rods 3 that are connected to the folding rod unit 5 cooperatively spread the cloth member 6 out so that the cloth member 6 may provide a sloping seat for the user.

Therefore, the third embodiment may achieve the same purpose and effects as the second embodiment.

Figure 14:
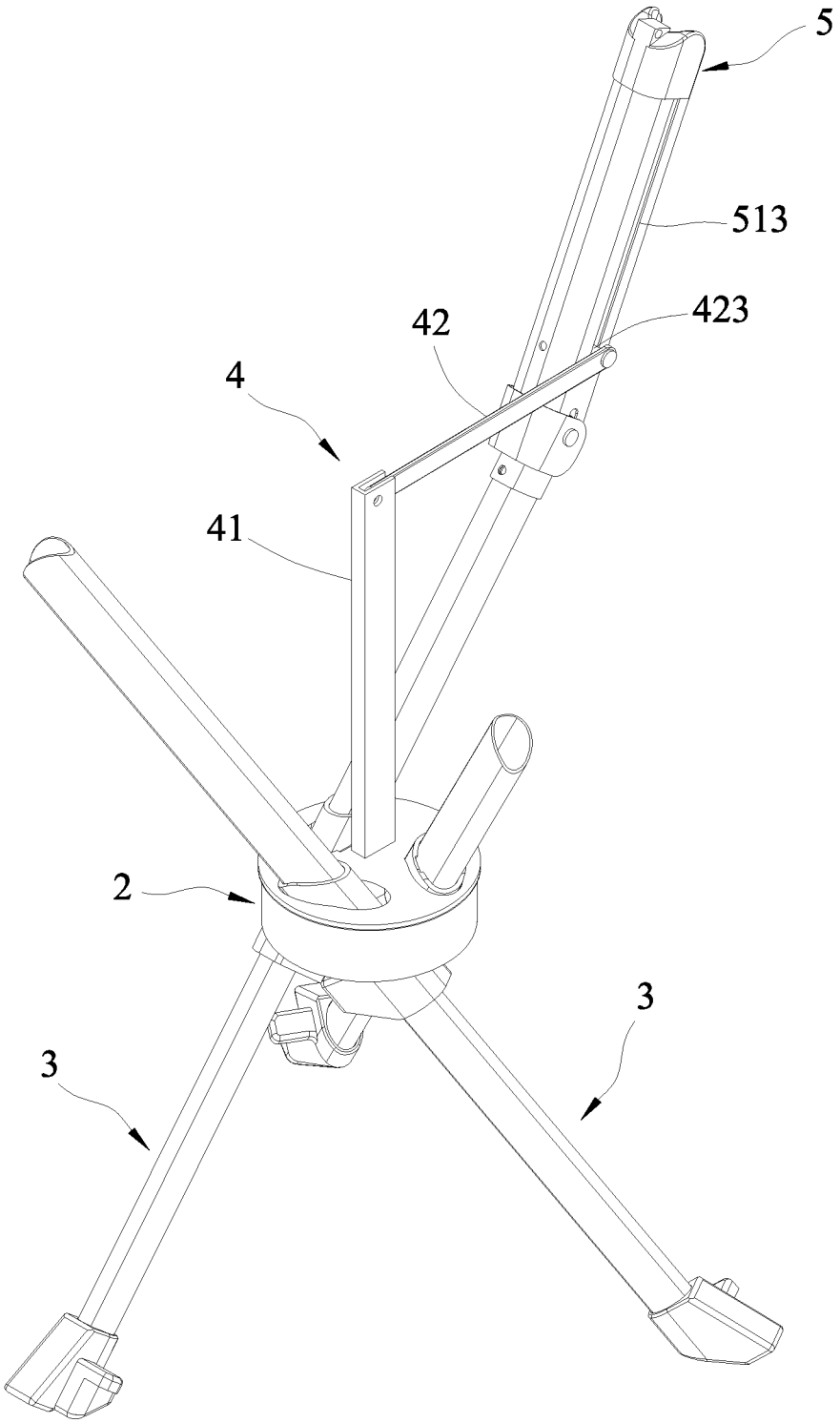
FIG. 14 is a perspective view of part of a fourth embodiment of the foldable device according to the disclosure.
Figure 15:
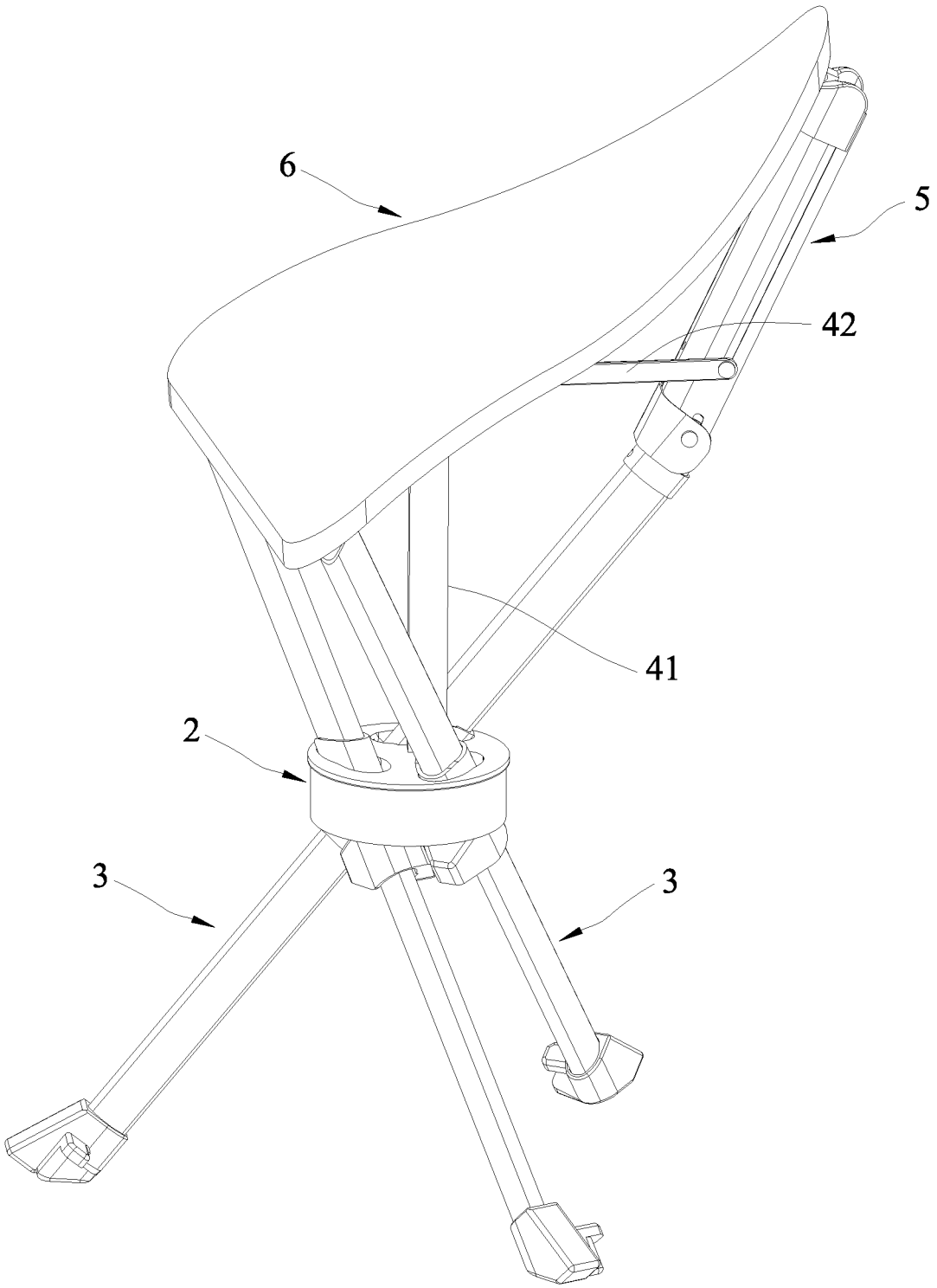
FIG. 15 is a perspective view of the fourth embodiment.

Referring to FIGS. 14 and 15, a fourth embodiment of the foldable device according to the disclosure is similar to the third embodiment, except for differences (i) to (k) below.

(i) The linkage unit 4 includes a pivot member 41 and a linkage rod 42 that is pivotably connected to the pivot member 41.

(j) The pivot member 41 of the linkage unit 4 extends upwardly from the pivot base 2. The linkage rod 42 is pivotably connected to a top section of the pivot member 41.

(k) The grooves 32 of the remaining two of the supporting rods 3 that are not connected to the folding rod unit 5 are omitted.

As such, the fourth embodiment may achieve the same purpose and effects as the third embodiment.

In summary, by virtue of the folding rod 51 of each of the folding rod units 5 being pivotably connected to the respective one of the supporting rods 3 and being movable relative to the respective one of the supporting rods 3 between the folded position and the expanded position, when each of the supporting rods 3 is in the supporting position and the folding rod 51 of each of the folding rod units is in the expanded position, the foldable device may provide a usable area that is larger than a usable area provided by a conventional foldable device. Therefore, the foldable device is relatively user-friendly, and the purpose of the disclosure is achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A foldable device comprising:

a pivot base;

three supporting rods extending through the pivot base, each of the supporting rods having a top section that is located above the pivot base;

a linkage unit including a pivot member that is located above the pivot base, and a linkage rod that is pivotably connected to the pivot member, the linkage rod having a pivot section that is pivotably connected to the pivot member, and a moving section that is opposite to the pivot section; and at least one folding rod unit pivotably connected to one of the supporting rods, the moving section of the linkage rod being slidably mounted to the at least one folding rod unit, the at least one folding rod unit including a folding rod that has a connecting section which is pivotably connected to the top section of the one of the supporting rods, and a swing section which is opposite to the connecting section, the folding rod of the at least one folding rod unit being movable relative to the one of the supporting rods between a folded position, in which the swing section of the folding rod is adjacent to the pivot base, in which the pivot section of the linkage rod is adjacent to the folding rod, and in which the moving section of the linkage rod is adjacent to the swing section of the folding rod, and an expanded position, in which the swing section of the folding rod is distal from the pivot base and is located at one side of the top section of the one of the supporting rods opposite to the pivot base, and in which the moving section of the linkage rod is distal from the swing section of the folding rod.

2. The foldable device as claimed in claim 1, wherein the folding rod of the at least one folding rod unit further has a groove that is located at the swing section thereof, the moving section of the linkage rod including a groove engaging member that extends through the groove of the folding rod of the at least one folding rod unit and that is movable along the groove of the at least one folding rod unit.

3. The foldable device as claimed in claim 2, wherein the linkage unit further includes two additional linkage rods each of which has a pivot section that is pivotably connected to the pivot member, and a moving section that is opposite to the pivot section and that has a groove engaging member, at least one of remaining two of the supporting rods that are not connected to the at least one folding rod unit further having a groove that is located at the top section thereof, the groove engaging member of the moving section of at least one of the additional linkage rods extending through the groove of the at least one of the remaining two of the supporting rods that are not connected to the at least one folding rod unit and being movable along the groove of the at least one of the remaining two of the supporting rods.

4. The foldable device as claimed in claim 1, wherein the at least one folding rod unit further includes a pivot shaft that is mounted to the top section of the one of the supporting rods, and a blocking wall that is mounted to the pivot shaft and that at least partially covers the top section of the one of the supporting rods, the blocking wall of the at least one folding rod unit abutting against the folding rod of the at least one folding rod unit when the folding rod of the at least one folding rod unit is in the expanded position, and restraining movement of the folding rod of the at least one folding rod unit so that when the folding rod of the at least one folding rod unit is in the expanded position, the swing section of the folding rod is distal from the pivot base and is located at the one side of the top section of the one of the supporting rods opposite to the pivot base, and the folding rod of the at least one folding rod unit is only allowed to move toward the folded position.

5. The foldable device as claimed in claim 4, wherein a cross section of the folding rod of the at least one folding rod unit is configured to be U-shaped so that when the folding rod of the at least one folding rod unit is in the folded position, at least a portion of the top section of the one of the supporting rods is accommodated in the folding rod of the at least one folding rod unit.

6. The foldable device as claimed in claim 1, further comprising a cloth member that is connected to the swing section of the folding rod of the at least one folding rod unit.

7. The foldable device as claimed in claim 1, wherein each of the supporting rods is movable relative to the pivot base between a storage position and a supporting position, when each of the supporting rods is in the storage position, the top sections of the supporting rods being proximate to each other, when each of the supporting rods is in the supporting position, the top sections of the supporting rods being distal from each other and the supporting rods respectively inclining in different directions.

8. The foldable device as claimed in claim 1, wherein the pivot member of the linkage unit extends upwardly from the pivot base.

* * * * *